US008910945B2

(12) United States Patent
McRobb

(10) Patent No.: US 8,910,945 B2
(45) Date of Patent: Dec. 16, 2014

(54) SEAL ASSEMBLY AND METHOD OF FORMING A SEAL ASSEMBLY

(75) Inventor: Graeme McRobb, Aberdeen (GB)

(73) Assignee: Tendeka B.V., Aberdeen (GB)

( * ) Notice: Subject to any disclaimer, the term of this patent is extended or adjusted under 35 U.S.C. 154(b) by 0 days.

(21) Appl. No.: 13/520,099

(22) PCT Filed: Mar. 11, 2011

(86) PCT No.: PCT/GB2011/000347

§ 371 (c)(1),
(2), (4) Date: Sep. 11, 2012

(87) PCT Pub. No.: WO2011/110819

PCT Pub. Date: Sep. 15, 2011

(65) Prior Publication Data

US 2013/0001881 A1 Jan. 3, 2013

(30) Foreign Application Priority Data

Mar. 11, 2010 (GB) ..... 1004045.9

(51) Int. Cl.
*E21B 33/03* (2006.01)
*E21B 33/12* (2006.01)

(52) U.S. Cl.
CPC ..... *E21B 33/1216* (2013.01); *E21B 33/1208* (2013.01); *Y10S 277/934* (2013.01)
USPC ..... 277/328; 277/337; 277/338; 277/934

(58) Field of Classification Search
USPC ..... 277/328, 329, 331, 335, 336, 337, 338, 277/342, 584; 166/387
See application file for complete search history.

(56) References Cited

U.S. PATENT DOCUMENTS

| | | | | |
|---|---|---|---|---|
| 2,358,908 | A | 9/1944 | Crickmer | |
| 4,151,875 | A * | 5/1979 | Sullaway | 166/126 |
| 4,203,607 | A * | 5/1980 | Brieger | 277/584 |
| 5,542,473 | A * | 8/1996 | Pringle | 166/120 |
| 6,162,031 | A * | 12/2000 | Tremoulet, Jr. | 417/569 |
| 6,626,438 | B2 * | 9/2003 | Walden | 277/510 |
| 6,769,695 | B2 * | 8/2004 | Stephens | 277/584 |
| 7,055,829 | B2 * | 6/2006 | Russell | 277/585 |
| 7,861,774 | B2 * | 1/2011 | Fehr et al. | 166/191 |
| 7,866,408 | B2 * | 1/2011 | Allison et al. | 166/387 |
| 7,866,669 | B2 * | 1/2011 | Kobayashi et al. | 277/584 |
| 8,397,820 | B2 * | 3/2013 | Fehr et al. | 166/332.1 |
| 2003/0051871 | A1 | 3/2003 | Swineford | |
| 2006/0186602 | A1 * | 8/2006 | Martin et al. | 277/338 |
| 2008/0060821 | A1 * | 3/2008 | Smith et al. | 166/387 |
| 2008/0110626 | A1 * | 5/2008 | Allison et al. | 166/288 |

(Continued)

FOREIGN PATENT DOCUMENTS

GB 2295836 A 6/1996

OTHER PUBLICATIONS

International Search Report and Written Opinion.

*Primary Examiner* — Vishal Patel
(74) *Attorney, Agent, or Firm* — Harness, Dickey & Pierce, PLC

(57) ABSTRACT

A downhole seal assembly comprises a base pipe upon which is mounted a seal element and a ring member, wherein the ring member is located adjacent an end region of the seal element. The ring member and seal element are adhered together with a bonding agent.

21 Claims, 2 Drawing Sheets

(56) References Cited

U.S. PATENT DOCUMENTS

| | | | | |
|---|---|---|---|---|
| 2008/0149351 | A1 | 6/2008 | Marya et al. | |
| 2009/0179383 | A1 | 7/2009 | Koloy et al. | |
| 2010/0300689 | A1* | 12/2010 | McRobb et al. | 166/285 |
| 2010/0307771 | A1* | 12/2010 | McRobb et al. | 166/387 |
| 2011/0101613 | A1* | 5/2011 | McRobb et al. | 277/312 |

* cited by examiner

SEAL ASSEMBLY AND METHOD OF FORMING A SEAL ASSEMBLY

FIELD OF THE INVENTION

The present invention relates to a seal assembly and method of forming the same, and in particular to a swellable downhole seal assembly, such as a swellable packer assembly.

BACKGROUND TO THE INVENTION

Sealing arrangements and assemblies are in widespread use in the oil and gas industry. One particular form of sealing assembly is the packer, which is generally used to seal an annular space within a wellbore, typically an annular space formed between a base pipe, such as a production tubular, and a bore wall. Packers may be used in zonal isolation operations, for example to permit targeted workover operations such as stimulation and fracing, to seal off zones to prevent water production, and the like.

Various forms of packer are currently in use, and typically comprise a sealing element, such as an annular rubber sealing element, arranged around an outer surface of a base pipe, wherein the sealing element is actuated or manipulated to radially extend into a sealing configuration. For example, inflatable packers are known in which one or more sealing elements are inflated to be radially extended. Mechanical packers are also known in which a mechanical arrangement is used to axially compress a sealing element to effect lateral expansion into a sealing configuration. Packers are also known in which a sealing element is formed of a swellable material, such as a swellable rubber, wherein the sealing element swells and expands upon exposure to a suitable activator to establish a seal. Swellable packers typically comprise a swellable material configured to swell upon exposure to an activator present within a wellbore, such as oil or water.

In many packer arrangements the sealing element is located between axially spaced rings which are secured to a base pipe. These rings may be provided for many purposes, such as to prevent axial movement or extrusion of the seal element when in use. In some arrangements, such as in mechanical packers, the rings may provide a reactive surface against which the seal element may be compressed during actuation. Furthermore, the rings may provide protection to the sealing element, for example during deployment into a wellbore. However, end regions of a sealing element adjacent to a ring may be vulnerable to damage or failure due to exposure to pressure and other conditions when in use. This failure may manifest itself as tearing of the rubber, for example tearing along an axial direction. Such failure has been observed to occur at unpredictable values, and often in proximity to the base pipe.

SUMMARY OF THE INVENTION

According to a first aspect of the present invention there is provided a downhole seal assembly comprising:

a base pipe;

a seal element mounted on the base pipe; and a ring member mounted on the base pipe and located adjacent an end region of the seal element, wherein the ring member and seal element are adhered together with a bonding agent.

In the present invention the ring member may be adhered to the seal element by the bonding agent to provide a degree of protection to the seal element at its end region, which has been recognised as being prone to unpredictable failure modes. For example, bonding the ring member and sealing element together with the bonding agent may assist to prevent exposure of the end region of the seal element to ambient conditions, which may otherwise cause a degree of failure in the seal element.

The ring member may be configured to axially retain the end region of the seal element. For example, the ring member may be configured to restrict axial displacement of the seal element, or a portion thereof, for example by forces, such as extrusion forces, setting forces, actuation forces or the like. The ring member may be configured to provide protection to the seal element, for example during deployment downhole.

In one embodiment the seal assembly may comprise a single ring member located adjacent one end region of the seal element. In other embodiments the seal assembly may comprise at least two ring members, at least one ring member located adjacent one end region of the seal element, and at least one other ring member located adjacent an opposite end region of the seal element. In this arrangement the seal element may be axially retained between at least two ring members. Opposing end regions of the seal element may be bonded to a respective ring member.

The seal element may be freely mounted on the base pipe.

At least a portion, and in some embodiments all of the seal element may be secured to the base pipe. At least a portion, and in some embodiments all of the seal element may be adhered to the base pipe with a bonding agent. The bonding agent used to adhere the ring member and seal element together may be the same, similar or different to that used to adhere the seal element and base pipe together.

At least a portion of the seal element may be interference fitted to the base pipe.

The ring member may be freely mounted on the base pipe.

The ring member may be secured to the base pipe. The ring member may be secured to the base pipe by, for example, locking screws, one or more threaded connections, interference fitting, welding, bonding or the like, or any suitable combination thereof.

The ring member may be mounted on the base pipe to define an annular gap therebetween. The annular gap may be provided to facilitate ease of mounting of the ring member on the base pipe. The annular gap may be void. Alternatively, a sealing arrangement may at least partially fill the annular gap. The sealing arrangement may be at least partially provided by the seal element. The sealing arrangement may assist to prevent migration of fluids or other materials through the annular gap. A portion of the seal element may be adhered to the ring member at the general region of the annular gap by a bonding agent. This arrangement may assist to prevent any separation or failure of the seal element at this location, thus assisting to maintain seal integrity.

An end face, such as an axial end face of the ring member may be adhered to a corresponding end face of the seal element.

The ring member may define an engagement region bonded to a corresponding engagement region defined on the seal element. Each corresponding engagement region may comprise one or more contact surfaces. One or more of the contact surfaces may be generally planar, cylindrical, conical, curved, toroidal or the like, or any suitable combination.

In one embodiment each engagement region may comprise a single contact surface. In other embodiments each engagement region may comprise multiple contact surfaces, for example two, three, or more.

Each engagement region may comprise a generally axial contact surface. Such an axial contact surface may face generally in a direction along an axial extent of the base pipe.

Each engagement region may comprise a generally circumferential contact surface. A circumferential contact surface of one engagement surface may face generally outwardly, generally away from the base pipe, and a circumferential contact surface of the corresponding engagement surface may face generally inwardly, generally towards the base pipe.

In one exemplary embodiment, the corresponding engagement regions of the ring member and seal element comprise both axial and circumferential contact surfaces.

The ring member may define a contact surface arranged to face an outer surface of the base pipe, with a separation gap defined therebetween. A portion of the seal element may be arranged within this separation gap.

The bonding agent may comprise a two-coat system, such as a primer coat and a top coat. The bonding agent may be water based, solvent based or the like. The bonding agent may comprise one or more of polymers, organic compounds, fillers or the like. Such components may be dissolved or dispersed within a carrier, such as an organic solvent system.

The bonding agent may be configured to provide or retain adhesion under manufacturing conditions of the seal assembly, such as pressure conditions, temperature conditions or the like. The bonding agent may be configured to provide or retain adhesion under moulding conditions. The bonding agent may be configured to provide or retain adhesion under vulcanizing conditions. The bonding agent may be configured to be cured under manufacturing conditions of the seal assembly.

The seal element may be arranged to be reconfigured between a non-sealing configuration and a sealing configuration. The seal element may be arranged to be radially extended or expanded to be reconfigured between a non-sealing configuration and a sealing configuration. The seal element may be arranged to be reconfigured between a non-sealing configuration and a sealing configuration by a mechanical arrangement, inflatable arrangement, swelling arrangement or the like, or any suitable combination thereof.

In use, the seal element may be arranged to establish a seal between the base pipe and a wall of a bore within which the seal assembly is located. The bore wall may be defined by a wall of an open or lined bore.

The seal element may comprise a rubber, nylon, metal, metal alloy, polymeric material or the like.

The seal element may comprise a non-swelling material.

The seal element may comprise a swellable material, such as a swellable elastomer. The seal element may be configured to swell to increase in volume upon exposure to a swelling activator. The swelling activator may comprise a fluid, such as water, hydrocarbon liquids or gases or the like. The swelling activator may comprise pressure, temperature, radioactivity, electrical stimulus or the like.

The ring member may comprise a metal or metal alloy.

The ring member may comprise a polymeric material, composite material or the like, or any suitable combination of materials.

The base pipe may be configured to be secured to a tubing string. The tubing string may comprise a production tubing string, casing or liner tubing string, coiled tubing string or the like. The base pipe may be configured to form a fluid communicating component of a tubing string. The base pipe may be configured to form part of a tubing string Opposing end portions of the base pipe may be interconnected within a tubing string, for example via threaded connections, welded connections or the like. In this arrangement the base pipe may comprise an oilfield tubular, such as a production tubular, casing tubular, liner tubular, pup joint or the like.

The base pipe may be configured to be mounted on an outer surface of a tubing string. For example, the base pipe may define a sleeve configured to be mounted externally over a portion of a tubing string.

The seal element may comprise a single component. Alternatively, the seal element may comprise multiple components, which collectively define the seal member.

The seal assembly may comprise a plurality of seal elements. At least two seal elements may be configured to be arranged directly adjacent each other. At least two seal elements may be configured to be at least partially separated by a ring member.

The ring member may comprise a single component. Alternatively, the ring member may comprise multiple components. This arrangement may permit ease of assembly of the seal assembly.

The seal assembly may define a packer.

According to a second aspect of the present invention there is provided a method of manufacturing a seal assembly comprising:

mounting a ring member and a seal element on a base pipe; and adhering the ring member to an end region of the seal element with a bonding agent.

The method according to the second aspect may be suitable for use in manufacturing a seal assembly according to the first aspect. Various features of the seal assembly of the first aspect may be provided by one or more appropriate manufacturing steps which may form non-essential features of the method according to the second aspect.

The method may comprise applying the bonding agent to at least one of the ring member and the seal. The bonding agent may be applied by painting, sponging, spraying, rolling, electrostatic processes, dipping or the like, or any suitable combination thereof. The bonding agent may be applied before or after one or both of the ring member and seal element are mounted on the base pipe.

In one embodiment the bonding agent may be applied to both the ring member and the seal element.

The bonding agent may be provided in one or more coats. For example, the bonding agent may comprise at least two coats. A first coat may comprise a primer.

The method may comprise treating the surface of one or both of the seal element and the ring member. Surface treating may comprise removal of oxides, surface roughening or the like.

The ring member may be secured to the base pipe, for example by one or more locking screws, grub screws, threading, interference fitting, adhesive bonding or the like.

The seal element may be secured to the base pipe. In one embodiment the seal element may be adhered to the base pipe by a bonding agent, such as the same bonding agent used to adhere the ring member and the seal element. The method may comprise coating at least one of the base pipe and the seal element with a bonding agent suitable for use in adhering said components together.

The method may comprise providing the seal element in a desired shape and then mounting the seal element on the base pipe. For example, the seal element may be formed or provided in an annular shape, and mounted over the outer surface of the base pipe.

The method may comprise forming the seal element in a desired shape directly on the base pipe. For example, the seal element may be provided in multiple components and subsequently assembled on the base pipe. The seal element may be formed by wrapping a seal element material around the base pipe to define the desired shape of the seal element. The seal element may be directly moulded on the base pipe to define a desired shape.

The seal element may comprise a rubber material, and the method may comprise vulcanizing the seal element. Vulcanization may be achieved in an autoclave at desired pressures and/or temperatures. The seal element may be vulcanized prior to being mounted on the base pipe. The seal element may be vulcanized after being mounted on the base pipe. It will be recognised that the process of vulcanization may cause a rubber material to have a degree of adherence to a component in intimate contact. However, the present invention by using a bonding agent provides assurance in the bond between the seal element and the ring member.

The seal element may be supported by a support arrangement while mounted on the base pipe. The support arrangement may comprise a shroud, such as a nylon shroud. The support arrangement may be provided to provide support during a treatment step of the seal element, such as a vulcanizing step. The support arrangement may be removable, for example following complete manufacture of the seal assembly, prior to use of the seal assembly or the like.

The method may comprise mounting the ring member of the base pipe to provide a clearance gap therebetween. The clearance gap may be provided to permit ease of mounting of the ring member on the base pipe. The clearance gap may remain void. The method may comprise positioning a portion of the seal element in the clearance gap. The method may comprise providing the bonding agent between the seal element and the ring member in the region of the clearance gap. The seal element may be formed to accommodate being located with the clearance gap. The seal element may be configured to be displaced, for example by flowing, into the clearance gap. This may be achieved during a vulcanizing process, during which the seal element may achieve a suitable degree of viscosity to permit material flow into the clearance gap.

According to a third aspect of the present invention there is provided a method of establishing a downhole seal, comprising:

providing a seal assembly according to the first aspect;

deploying the seal assembly into a wellbore; and reconfiguring the seal element to establish a seal between a bore wall and the base pipe.

The method may comprise deploying the seal assembly on or as part of a tubing string.

The method may comprise mechanically actuating the seal element to be reconfigured to establish a seal. The method may comprise causing at least a portion of the seal element to swell to be reconfigured to establish a seal.

Other aspects of the present invention may relate to performing wellbore operations using a seal assembly according to the first aspect, such as zonal isolation, workover, fracing, inflow control operations or the like, or any suitable combination of wellbore operations.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
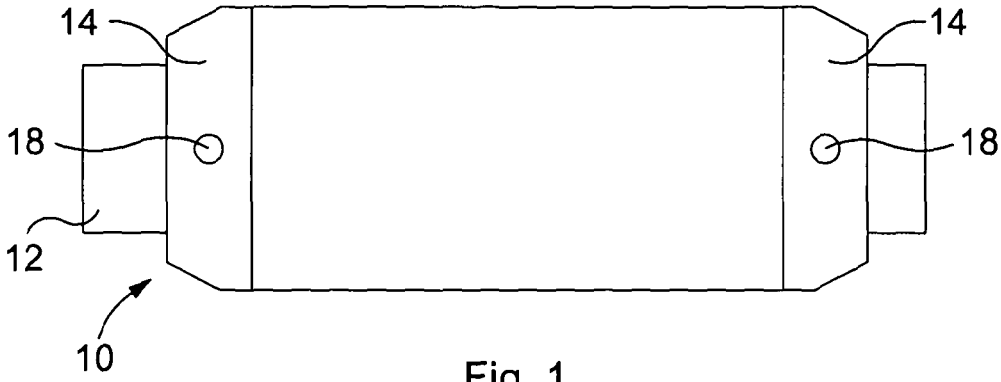
FIG. 1 shows a seal assembly in accordance with an embodiment of the present invention.

A seal assembly, generally identified by reference numeral 10, in accordance with an embodiment of the present invention is shown in FIG. 1. The seal assembly 10 is illustrated in the form of a packer and comprises a base pipe 12 which supports a pair of ring members 14 and a seal element 16 retained between the ring members 14. The base pipe 12 in the embodiment shown is provided in the form of a pup joint and is intended to form part of a tubing string (not shown), and thus to be deployed into a wellbore (not shown) on the tubing string.

Although various types of materials may be used in different embodiments to form the seal element, in the present embodiment the seal element 16 comprises a swellable rubber material which is configured to swell upon exposure to an activator, such as oil or water. The seal element 10 may therefore be activated to swell to expand from a non-sealing configuration as shown in FIG. 1, to a sealing configuration (not illustrated), in which the seal element extends radially outwardly to engage a wall of a wellbore within which the seal assembly 10 is located.

The ring members 14 are secured to the base pipe 12 via locking screws 18 and are provided to assist to protect the seal element 16 during deployment into a wellbore, and also to assist to prevent displacement of the seal element, for example by extrusion forces, when the seal element is activated to form a seal.

Figure 2:
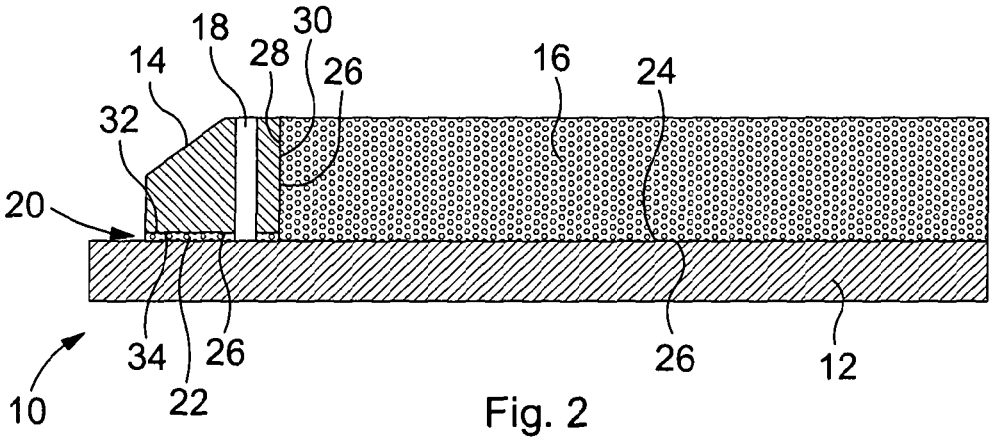
FIG. 2 is an enlarged sectional view of a region of the seal assembly of FIG. 1.

Reference is now additionally made to FIG. 2 in which a longitudinal cross sectional view of a portion of the seal assembly 10 of FIG. 1 is shown. As shown in FIG. 2, each ring member 14 (only one shown) is mounted around the base pipe 12 with an annular clearance gap 20 defined therebetween. A portion 22 of the seal element 16 is located within the clearance gap 20 to assist to prevent the passage of fluids across this gap 20. As will be described in further detail below, the seal element 16 is vulcanized while located on the base pipe 12 which provides material flow of the seal element 16 into the clearance gap 20 to define portion 22.

The inner face 24 of the seal element 16 is adhered to the base pipe 12 with a bonding agent 26, such as a water or solvent based bonding agent.

Further, each ring member 14 is adhered to opposing end regions of the seal element 16 by the same bonding agent 26. Specifically, each ring member 14 defines an axial end face 28 which is bonded to a corresponding axial end face 30 of the seal element 16, and a circumferential face 32 which is bonded to a corresponding circumferential face 34 of the seal element 16, specifically seal element portion 22. Accordingly, the seal element 16 in the embodiment shown is fully adhered by a bonding agent 26 to both the base pipe 12 and the ring members 14. This assists to prevent exposure of the bonded regions of the seal element 16 to ambient conditions when the seal assembly 10 is in use, which may otherwise be prone to unpredictable failure modes. Such a failure mode is demonstrated, for exemplary purposes, in FIG. 3, reference to which is now made.

Figure 3:
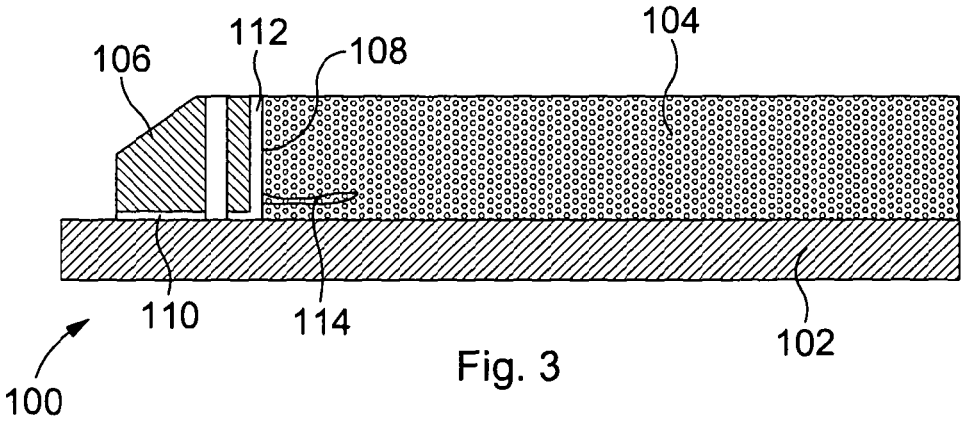
FIG. 3 is an enlarged sectional view of a seal assembly, illustrating a potential failure mode.

FIG. 3 a cross sectional view of a portion of a seal assembly 100 which includes a base pipe 102, a seal element 104 and a pair of ring members 106 (only one shown) located on either axial side of the seal element 104. In this illustration the end face 108 of the seal element 104 is exposed to ambient conditions via axially and circumferentially extending gaps 110, 112 formed between the ring members 14 and the seal element 104. This may result in a failure region 114 developing in the seal element 104, which can have a significant detrimental effect on the integrity and effectiveness of the seal assembly 100.

A method of manufacturing the seal element 10 first shown in FIG. 1 in accordance with an exemplary embodiment of the present invention will now be described with reference to FIGS. 4 to 8.

Figure 4:
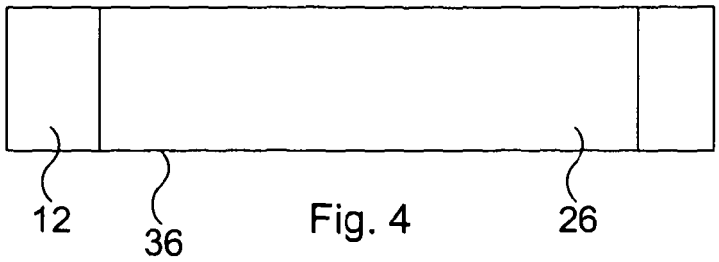
FIGS. 4 to 8 represent steps in a process used to manufacture the seal assembly of FIG. 1, and specifically.

Referring initially to FIG. 4, the outer surface 36 of the base pipe 12 is coated with the bonding agent 26, for example by spraying. Although a single coat of bonding agent 26 is illustrated, multiple coats may be used, and one or more coats may function as a primer coat.

Figure 6:
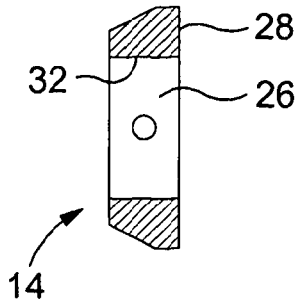
Figure 5:
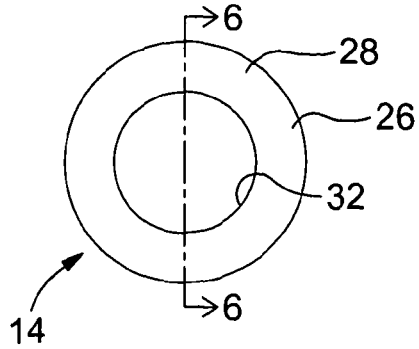

Further, the bonding agent is also coated on the axial end face 28 of each ring member 14, as shown in FIG. 5, and also on the circumferential face 32 of each ring member 14, as shown in FIG. 6, which is a sectional view taken through line 6-6 of FIG. 5.

Figure 7:
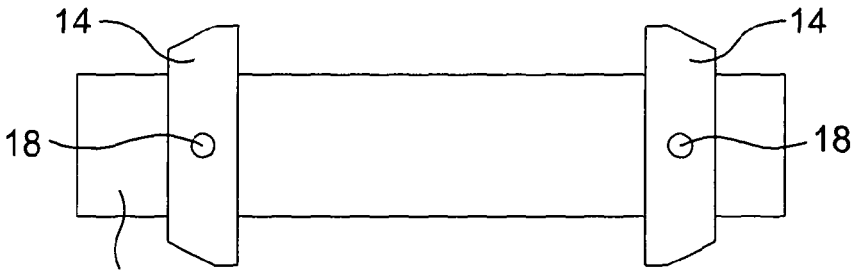
Figure 8:
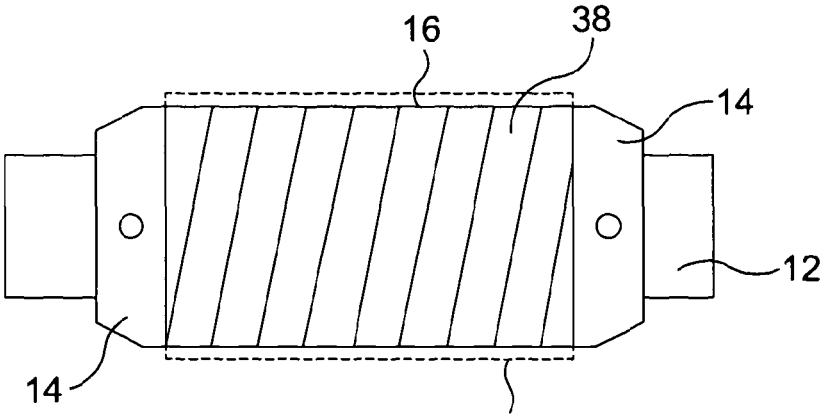

Once all necessary surfaces are coated the ring members 14 are mounted and secured to the base pipe 12 via locking screws 18, as shown in FIG. 7.

Following this, the seal element 16 is formed by wrapping one or more strips 38 of swellable rubber around the base pipe 12 between the end rings 14. Once the general form of the seal element 16 has been created, a nylon shroud 40 (shown in broken outline) is arranged around the seal element 16 to provide support. Following this the seal assembly 10 is treated in an autoclave (not illustrated) to vulcanize the formed seal element 16. The bonding agent 26 functions to ensure adherence of the seal element 16 to both the ring members 14 and the base pipe 12. Vulcanizing the seal element is arranged to cause the some material flow under each ring member 14 to establish seal element portion 22, as shown in FIG. 2.

It should be understood that the embodiments described above are merely exemplary and that various modifications may be made thereto without departing from the scope of the present invention. For example, a seal assembly may be provided with multiple seal elements, which may be arranged in contact with each other, or partially or completely separated by further ring members. Also, the various components of the seal assembly may be first assembled, or at least some components may be partially assembled, and then coated with the bonding agent. Additionally, the seal element may be formed on the base pipe prior to mounting of the ring members.

The invention claimed is:

1. A downhole seal assembly comprising:

a hollow base pipe;

a swellable seal element mounted on the base pipe, the swellable seal element defining a first end face, the swellable seal element configured to swell to increase in volume upon exposure to a swelling activator, the swelling activator including a fluid; and a ring member having a second end face and a third end face, the ring member secured to the base pipe to define a gap between at least a portion of the ring member and the base pipe that extends from the second end face to the third end face of the ring member, the second end face being adhered to the first end face by a first bonding agent;

wherein a portion of the swellable seal element extends from the first end face into at least a portion of the gap between the ring member and the base pipe.

2. The downhole seal assembly according to claim 1, wherein the ring member is configured to axially retain the end region of the seal element.

3. The downhole seal assembly according to claim 1, comprising at least two ring members, at least one ring member located adjacent one end region of the seal element, and at least one other ring member located adjacent an opposite end region of the seal element.

4. The downhole seal assembly according to claim 1, wherein at least a portion of the seal element is adhered to the base pipe with a bonding agent.

5. The downhole seal assembly according to claim 1, wherein the portion of the seal element that extends from the first end face into at least a portion of the gap between the ring member and the base pipe is adhered to the base pipe by a second bonding agent.

6. The downhole seal assembly according to claim 1, wherein at least one of the first end face and the second end face is at least one of generally planar, cylindrical, conical, curved and toroidal.

7. The downhole seal assembly according to claim 1, wherein the first bonding agent is configured to provide or retain adhesion under manufacturing conditions of the seal assembly.

8. The downhole seal assembly according to claim 1, wherein the seal element is arranged to be reconfigured between a non-sealing configuration and a sealing configuration.

9. The downhole sealing assembly according to claim 1, wherein the seal element is arranged to be reconfigured between a non-sealing configuration and a sealing configuration by a mechanical arrangement.

10. The downhole seal assembly of claim 1, wherein the ring member is in the shape of a solid circular band.

11. A method of manufacturing a downhole seal assembly comprising:

mounting a ring member having a first end face and a second end face on a hollow base pipe to define gap between at least a portion of the ring member and the base pipe that extends from the first end face to the second end face of the ring member;

mounting a swellable seal element on the base pipe, the swellable seal element defining a third end face, the swellable seal element configured to swell to increase in volume upon exposure to a swelling activator, the swelling activator including a fluid;

at least partially filling the gap with a portion of the seal element; and adhering the second end face of the ring member to the third end face of the seal element with a first bonding agent.

12. The method according to claim 11, further comprising: securing the seal element to the base pipe by bonding.

13. The method according to claim 11, further comprising: forming the seal element in a desired shape directly on the base pipe.

14. The method according to claim 11, further comprising: wrapping a seal element material around the base pipe to define the desired shape of the seal element.

15. The method according to claim 11, further comprising; vulcanizing the seal element.

16. The method according to claim 11, wherein the at least partially filling of the gap with the portion of the seal element includes providing a second bonding agent between the portion of the seal element and the base pipe.

17. The method according to claim 11, wherein the seal element is caused to flow into the gap.

18. The method according to claim 17, wherein the seal element is caused to flow into the gap during vulcanizing of the seal element.

19. The method of claim 11, wherein the ring member is in the shape of a solid circular band.

20. A method of establishing a downhole seal, comprising:

providing a seal assembly comprising a hollow base pipe, a swellable seal element mounted on the base pipe, and a ring member having a first end face and a second end face mounted on the base pipe to define a gap between at least a portion of the ring member and the base pipe that extends from the first end face to the second end face of the ring member, the swellable seal element defining a third end face, the swellable seal element configured to swell to increase in volume upon exposure to a swelling activator, the swelling activator including a fluid, the ring member being located adjacent an end region of the seal element, wherein the gap is at least partially filled with a portion of the seal element;

adhering the second end face to the third end face with a first bonding agent;

deploying the seal assembly into a wellbore; and reconfiguring the seal element to establish a seal between a bore wall and the base pipe.

21. The method of claim 20, wherein the ring member is in the shape of a solid circular band.

* * * * *

(12) SUPPLEMENTAL EXAMINATION CERTIFICATE

United States Patent (10) Number: US 8,910,945 F1

McRobb (45) Certificate Issued: Aug. 19, 2015

Control No.: 96/030,016 Filing Date: Jul. 10, 2015

Primary Examiner: Jeffrey R. Jastrzab

No substantial new question of patentability is raised in the request for supplemental examination. See the Reasons for Substantial New Question of Patentability Determination in the file of this proceeding.

(56) Items of Information

U.S. PATENT DOCUMENTS

| | | |
|---|---|---|
| 2007/0144733 | 06/2007 | Murray et al. |
| 2003/0209862 | 11/2003 | Keene et al. |
| 2008/0190600 | 08/2008 | Shkurti et al. |

FOREIGN PATENT DOCUMENTS

| | | |
|---|---|---|
| GB | 2309722 A | 08/1997 |